US012104310B2

(12) United States Patent
Huang et al.

(10) Patent No.: US 12,104,310 B2
(45) Date of Patent: Oct. 1, 2024

(54) ADDITIVE AUTO-FEEDING DEVICE AND WASHING MACHINE

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Yuliang Jiang, Shandong (CN)

(73) Assignees: QINGDAO HAIER DRUM WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 709 days.

(21) Appl. No.: 17/414,636

(22) PCT Filed: Jan. 16, 2020

(86) PCT No.: PCT/CN2020/072362

§ 371 (c)(1),
(2) Date: Jun. 16, 2021

(87) PCT Pub. No.: WO2020/147767

PCT Pub. Date: Jul. 23, 2020

(65) Prior Publication Data

US 2022/0064843 A1 Mar. 3, 2022

(30) Foreign Application Priority Data

Jan. 18, 2019 (CN) ..... 201910047924.X
Jan. 18, 2019 (CN) ..... 201910047951.7
Jan. 18, 2019 (CN) ..... 201910048382.8

(51) Int. Cl.
*D06F 39/02* (2006.01)
*D06F 33/37* (2020.01)
(Continued)

(52) U.S. Cl.
CPC ..... *D06F 39/022* (2013.01); *D06F 33/37* (2020.02); *D06F 39/088* (2013.01); *D06F 33/34* (2020.02)

(58) Field of Classification Search
CPC ..... D06F 33/34; D06F 33/37; D06F 33/54; D06F 33/57; D06F 39/022; D06F 39/088
See application file for complete search history.

(56) References Cited

U.S. PATENT DOCUMENTS

2006/0117811 A1* 6/2006 Kinnetz ..... D06F 39/022 68/17 R
2012/0151970 A1* 6/2012 Leibman ..... D06F 39/00 68/17 R
2012/0240344 A1* 9/2012 Lv ..... D06F 39/022 68/17 R
(Continued)

FOREIGN PATENT DOCUMENTS

CN 1749473 A 3/2006
CN 1873084 A 12/2006
(Continued)

OTHER PUBLICATIONS

Extended European Search Report dated Nov. 16, 2020, issued in corresponding European Patent Application No. 20723972.4-1016 / 3702516 PCT/CN2020072362. (7 pages).
(Continued)

*Primary Examiner* — Joseph L. Perrin
(74) *Attorney, Agent, or Firm* — BUCHANAN, INGERSOLL & ROONEY PC

(57) ABSTRACT

An additive auto-feeding device, including a water supply flow channel; a liquid storage box containing an additive; a suction structure capable of sucking the additive to the flow channel and transferring the additive to a water outlet; and an anti-back suction device at a pressure adjusting opening of the flow channel. When water enters the flow channel, under the pressure effect of flowing water, the anti-back suction device closes the pressure adjusting opening; and
(Continued)

when negative pressure is generated in the flow channel, the anti-back suction device opens the pressure adjusting opening for adjusting the pressure in the flow channel. The pressure adjusting device automatically adjusts opening and closing of an air hole to correspondingly adjust the pressure in a tube and avoid existence of negative pressure in the tube, thus achieving a backflow prevention function.

20 Claims, 7 Drawing Sheets

(51) Int. Cl.
*D06F 39/08* (2006.01)
*D06F 33/34* (2020.01)

(56) References Cited

U.S. PATENT DOCUMENTS

| | | | | |
|---|---|---|---|---|
| 2012/0246836 | A1* | 10/2012 | Leibman | D06F 39/02 68/17 R |
| 2016/0326684 | A1* | 11/2016 | Lv | D06F 39/022 |
| 2018/0266036 | A1 | 9/2018 | Leibman et al. | |

FOREIGN PATENT DOCUMENTS

| | | | |
|---|---|---|---|
| CN | 102041664 | A | 5/2011 |
| CN | 102587093 | A | 7/2012 |
| CN | 203498661 | U | 3/2014 |
| CN | 104178975 | A | 12/2014 |
| CN | 205618745 | U | 10/2016 |
| CN | 106637835 | A | 5/2017 |
| CN | 107059350 | A | 8/2017 |
| CN | 108866962 | A | 11/2018 |
| EP | 3091113 | A1 | 11/2016 |
| JP | H11-19391 | A | 1/1999 |
| JP | 2018080481 | A | 5/2018 |
| JP | 2018082917 | A | 5/2018 |
| JP | 2018130238 | A | 8/2018 |

OTHER PUBLICATIONS

International Search Report and Written Opinion mailed on Apr. 15, 2020, by the China National Intellectual Property Administration (ISA/CN) as the International Searching Authority for International Application No. PCT/CN2020/072362.

Notice of Reasons for Refusal issued in Japanese Application No. 2021-538071; Mailed Aug. 22, 2023; 8 pages including English Translation.

Office Action issued in Chinese Application No. 201910047924.X; Issued Nov. 3, 2021; 17 pages including English Translation.

Office Action issued in Chinese Application No. 201910047951.7; Issued Nov. 1, 2021; 10 pages including English Translation.

Office Action issued in Chinese Application No. 201910048382.8; Issued Nov. 3, 2021; 11 pages including English Translation.

* cited by examiner

ADDITIVE AUTO-FEEDING DEVICE AND WASHING MACHINE

TECHNICAL FIELD

The disclosure relates to the technical field of clothes processing devices and in particular, relates to an additive auto-feeding device and a washing machine.

BACKGROUND

With increase of the level of consumption, a consumer proposes higher requirements on quality of daily life, thus requirements for smart home appliances are generated. Concerning most washing machine products sold in current market, an auto-feeding system which can smartly add detergent and softener is mostly adopted. After a user adds a washing agent once in a large amount, the trouble of adding it each time for washing is saved afterward.

However, some problems are also caused simultaneously.

A suction device for sucking a washing additive with negative pressure is generally installed on a water path of the auto-feeding device, e.g. a Venturi tube, a suction pump and the like. The suction device has some requirements on water supply flow in the actual using process. When water supply flow is excessively large and water pressure is excessively big, water flow will generate very great closing pressure after passing through a tube in front of a suction structure. Closing pressure is of great risk for the sealing property of the feeding device. When the flow is excessively large, even if sealing measures of the water path are solved through various measures, risks for leakage, blasting and cracks of the tube still exist.

Meanwhile, there exists a case that water pressure difference at different segments of a flow channel is excessively large and it is easy to form negative pressure in the flow channel, thus affecting normal suction of a washing additive and smooth flow of water in the flow channel. In particular, when the suction structure adopts a Venturi tube, as the water inlet end of the Venturi tube is a tube with the smallest diameter, it is extremely easy to generate closing pressure, which causes that the inlet water flow of the Venturi tube is hard to reach using requirements, and the washing additive can not be sucked.

In addition, the suckback prevention requirement is present in standards of the washing machines worldwide. Therefore, a suckback prevention function of the auto-feeding device is indispensable. In order to realize the above function, a one-way check valve is installed in the flow channel of the auto-feeding device or an air gap is arranged for connecting the tube with atmosphere. However, there is not a very good structural form capable of realizing the suckback prevention function of a water inlet flow channel in the water path of the current auto-feeding device.

For this purpose, the disclosure is proposed herein.

SUMMARY

The disclosure aims to provide an additive auto-feeding device and a washing machine applying the device, so as to realize the purpose of automatic pressure adjustment and diversion of water supply flow. Another objective of the disclosure is to provide an additive auto-feeding device to realize the purpose of a suckback prevention function for water supply flow.

In order to achieve the above purposes, the disclosure specifically adopts the following technical solution:

An additive auto-feeding device, comprising a water supply flow channel; a liquid storage box containing an additive inside; a suction structure capable of sucking the additive in the liquid storage box to the water supply flow channel and then transferring the additive along with water flow to a water outlet; and an anti-back suction device arranged at a pressure adjusting opening of the water supply flow channel, wherein when water enters the water supply flow channel, under the pressure effect of flowing water, the anti-back suction device is controlled to close the pressure adjusting opening; and when negative pressure is generated in the water supply flow channel, the anti-back suction device is controlled to open the pressure adjusting opening for adjusting pressure in the water supply flow channel.

Further, the anti-back suction device comprises a valve plate correspondingly covering the pressure adjusting opening at the inner side of the water supply flow channel; preferably, the periphery of the valve plate protrudes from the pressure adjusting opening for sealed contact of the valve plate with the inner wall of the water supply flow channel when the valve plate seals the pressure adjusting opening under the water pressure, and at least one lap of sealing ring is arranged at an abutted surface of the valve plate and the water supply flow channel.

Further, the outer side of the valve plate towards the water supply flow channel is provided with a bracket penetrating the pressure adjusting opening, an outgoing end of the bracket is provided with an end cover and a spring structure is clamped between the end cover and a valve core, to make the valve plate only capable of moving back and forth along the axis of the pressure adjusting opening under the limiting of the bracket.

Further, an opening is arranged on the valve plate, a valve core is installed at the opening, the valve core is installed to the opening through an elastic structure, and the valve core correspondingly seals the pressure adjusting opening under an elastic force of the elastic structure, when the pressure of water flowing through a pressure adjusting chamber is greater than a, the water flow pressure overcomes elastic force and drives the valve core to open the pressure adjusting opening for pressure adjustment and diversion of water in the water supply flow channel.

Further, the valve core is arranged at the pressure adjusting opening at the outer side of the pressure adjusting chamber, the elastic structure provides an elastic force for the valve core from the exterior of the pressure adjusting chamber to the interior of the pressure adjusting chamber, thereby making the valve core correspondingly seal the pressure adjusting opening; water flowing through the pressure adjusting chamber applies pressure to the valve core for moving outwards, and when water flow pressure is greater than a set value, the water flow pressure overcomes the elastic force to drive the valve core to move outwards and open the pressure adjusting opening.

Further, the pressure adjusting opening communicates with a diversion flow channel, and the end of the diversion flow channel communicates with the water outlet of the auto-feeding device.

Further, a pressure adjusting chamber is arranged on the water supply flow channel, a pressure adjusting opening is arranged on the pressure adjusting chamber, the valve plate correspondingly covers the pressure adjusting opening at the inner side of the pressure adjusting chamber, and the valve plate correspondingly seals the pressure adjusting opening under the pressure of water in the chamber; the valve core correspondingly covers an opening of the valve plate at the outer side of the pressure adjusting chamber and the valve core opens or has the trend of opening the opening under the pressure of water in the chamber.

Further, upper and lower sides of the pressure adjusting chamber in the vertical direction are respectively provided with an inlet and the pressure adjusting opening, one side wall of the pressure adjusting chamber is provided with an outlet connected with the suction structure, and the valve plate overcomes gravity under the pressure of water flowing into the chamber to move upward to close the pressure adjusting opening; preferably, the inlet and the pressure adjusting opening are arranged coaxially.

Further, the lower side of the valve plate is arranged opposite to the inlet for moving downwards to seal and cover the inlet under gravity, when water supply in the water supply flow channel is stopped and negative pressure is generated in the pressure adjusting chamber.

The disclosure further provides a washing machine, wherein: the auto-feeding device according to any one of the above is installed thereto, the water outlet of the auto-feeding device is connected to a washing tub to feed the additive in the liquid storage box sucked by the water flow in the water supply flow channel into the washing tub along with inlet water of the washing machine.

In order to achieve the above purpose, the disclosure can also specifically adopt the following technical solution:

An additive auto-feeding device, comprising a water supply flow channel which can transfer water to a suction structure; a liquid storage box containing an additive inside; the suction structure capable of sucking the additive in the liquid storage box and then transferring the additive along with water flow to a water outlet by generating negative pressure for water flow in the water supply flow channel; and a pressure adjusting device arranged on the water supply flow channel for adjusting the pressure of flowing water so as to perform diversion of water flowing to the suction structure when the pressure of water supply flow is excessively great.

Further, a pressure adjusting chamber is arranged on the water supply flow channel, a pressure adjusting opening is arranged on the pressure adjusting chamber, the pressure adjusting device is arranged at the pressure adjusting opening, such that the pressure adjusting device opens the pressure adjusting opening under the pressure of water flow when the pressure of water supply flow is greater than a set value.

Further, the pressure adjusting device includes a valve core installed at the pressure adjusting opening via an elastic structure, and the valve core correspondingly seals the pressure adjusting opening under an elastic force of the elastic structure, and when the pressure of water flowing through the pressure adjusting chamber is greater than a set value, the water flow pressure overcomes elastic force and drives the valve core to open the pressure adjusting opening.

Further, the valve core is arranged at the pressure adjusting opening at the outer side of the pressure adjusting chamber, the elastic structure provides an elastic force for the valve core from the exterior of the pressure adjusting chamber to the interior of the pressure adjusting chamber, thereby making the valve core correspondingly seal the pressure adjusting opening; water flowing through the pressure adjusting chamber applies pressure to the valve core for moving outwards, and when water flow pressure is greater than a set value, the water flow pressure overcomes the elastic force to drive the valve core to move outwards and open the pressure adjusting opening.

Further, the pressure adjusting opening communicates with a diversion flow channel, and the end of the diversion flow channel communicates with the water outlet of the auto-feeding device.

Further, the pressure adjusting device comprises a valve plate which can generate movement towards and backwards the pressure adjusting opening with a change in pressure in the water supply flow channel, such that the valve plate is driven to correspondingly seal the pressure adjusting opening under the pressure of water flowing through the water supply flow channel and the valve plate opens the pressure adjusting opening under gravity when negative pressure is generated in the water supply flow channel.

Further, an opening for connecting the exterior and the interior of the water supply flow channel is arranged on the valve plate, the valve core is arranged at the opening and the valve core is made to correspondingly seal the opening under the driving of the elastic structure.

Further, the valve core is correspondingly arranged at the opening of the valve plate at the outer side of the water supply flow channel; a bracket extending towards the outer side of the water supply flow channel and penetrating the pressure adjusting opening is provided, a spring in a compressed state is arranged between the bracket and the valve plate, and the two ends of the spring are respectively connected to the bracket and the valve core.

Preferably, the valve plate is provided with a bracket penetrating the pressure adjusting opening towards the outer side of the water supply flow channel, the upper end of the bracket is provided with an end cover having hollow holes and the lower end thereof is connected to the valve plate, the spring is clamped between the end cover and the valve plate in a compressed state, the two ends of the spring are respectively connected to the valve plate and the end cover, such that the valve plate is limited to the pressure adjusting opening by the bracket and only generates movement back and forth along the axis of the pressure adjusting opening.

Further, the periphery of the valve plate protrudes from the pressure adjusting opening for sealed contact of the valve plate with the inner wall of the water supply flow channel when the valve plate seals the pressure adjusting opening under the water pressure, and at least one lap of sealing ring is arranged at an abutted surface of the valve plate and the water supply flow channel; preferably, the periphery of the valve plate is packed with a lap of sealing ring made of elastic material.

The disclosure further provides a washing machine, with the auto-feeding device according to any one of the above installed thereto, the water outlet of the auto-feeding device is connected to a washing tub to feed the additive in the liquid storage box sucked by the water flow in the water supply flow channel into the washing tub along with inlet water of the washing machine.

In order to achieve the above purpose, the disclosure can also specifically adopt the following technical solution:

An auto-feeding device, comprising a water box, wherein a pressure adjusting chamber is arranged on the water box, an inlet connected with a water inlet tube and an outlet connected with a suction structure are arranged on the pressure adjusting chamber, the top of the pressure adjusting chamber is further provided with a pressure adjusting opening communicating with the exterior, a valve plate which can move vertically is arranged in the pressure adjusting chamber to correspondingly seal or open the pressure adjusting opening under the pressure in the chamber; an opening is arranged on the valve plate, and a valve core for sealing the opening is arranged at the opening, and the valve core is installed to the valve plate through an elastic structure and driven to open the opening when the pressure of water flowing in the water supply flow channel is excessively great.

Further, the outlet is arranged at one side of the pressure adjusting chamber and connected to a small-caliber inlet end of a Venturi tube forming a suction structure; the inlet is arranged at the bottom of the pressure adjusting chamber and the inlet of the pressure adjusting chamber is arranged coaxially with the pressure adjusting opening.

Further, the top wall of the pressure adjusting chamber is provided with a through sleeve, a hollow channel in the sleeve forming the pressure adjusting opening; the valve plate is arranged at the lower end of the sleeve and correspondingly covers the lower end of the sleeve, and the valve plate is connected with a limiting structure plugged with the sleeve such that the valve plate moves back and forth along the vertical direction under the joint effect of gravity and water flow pressure; preferably, the limiting structure comprises a vertically extending bracket, the outer wall of the bracket correspondingly contacts with the inner wall of the sleeve, such that the bracket is limited by the sleeve, the lower end of the bracket is fixedly connected to the valve plate, and the upper end of the bracket is provided with an end cover; the height of the bracket is not greater than the height of the sleeve and not less than a height difference between the lower end of the sleeve and the inlet of the pressure adjusting chamber; preferably, the end cover is provided with a plurality of hollow holes penetrating the upper and lower sides of the end cover.

Further, the opening is arranged at the center of the valve plate, the valve core has a columnar shape and penetrates the opening, the upper end of the columnar valve core is provided with a lap of protruding portion protruding outward, and the periphery of the protruding portion is beyond the opening, such that the columnar valve core correspondingly seals the opening downwards under gravity.

Further, the bottom of the pressure adjusting chamber is provided with a groove sunken downwards, the shape of the groove opening is arranged corresponding to the valve plate such that the lower side of the valve plate is in sealing contact with the periphery of the groove opening of the pressure adjusting chamber when the valve plate falls to the bottom of the pressure adjusting chamber under gravity and/or negative pressure for closing the inlet; preferably, the lower end of the columnar valve core protrudes the valve plate and is corresponding to the inlet of the pressure adjusting chamber such that the lower end of the columnar valve core is correspondingly plugged with the inlet in a sealing manner when the valve plate falls to the bottom of the pressure adjusting chamber under gravity and/or negative pressure.

Further, the inlet of the pressure adjusting chamber is arranged between the sleeve and the side wall of the pressure adjusting chamber, outer circumference of the valve plate is greater than the circumference of the lower end of the sleeve and smaller than the circumference of the inner side wall of the pressure adjusting chamber, such that water flowing into the chamber from the inlet flows to the outlet from a gap between the sleeve and the wall of the pressure adjusting chamber.

Further, the elastic structure is a vertically extending spring, which is installed between the end cover of the bracket and the valve core in a compressed state, the two ends of the spring being respectively connected to the end cover and the valve core; preferably, the bracket comprises a plurality of vertically extending connecting ribs, the upper end of the connecting rib is fixedly connected to the end cover, and the lower end of the connecting rib is fixedly connected to the valve plate, and a hollow area for water to flow through is arranged between adjacent connecting ribs and/or on the connecting ribs; preferably, the connecting ribs each are arranged along a barrel face fitted contacted to the inner wall of the sleeve and the spring is arranged in an area enclosed by the connecting ribs.

Further, the water box includes a top cover buckled to the top, the top cover further correspondingly covers and buckles to the top of the pressure adjusting chamber, which is integrally formed with the water box or the top cover; the upper side of the top cover is provided with a diversion flow channel, the pressure adjusting opening arranged on the top of the pressure adjusting chamber communicates with the diversion flow channel, which extends to the water outlet of the water box or into the washing tub, such that the pressure adjusting opening directly communicates with the external atmosphere.

Further, at least one lap of sealing ring is arranged at an abutted surface of the valve plate and the pressure adjusting opening, at least one lap of sealing ring is arranged at an abutted surface of the valve plate and the inlet of the pressure adjusting chamber, and at least one lap of sealing ring is arranged at an abutted surface of the valve plate and the valve core; preferably, the periphery of the valve plate is packed with a sealing gasket consisting of a layer of elastic material and covering the upper and lower sides of the valve plate; and the periphery of the middle part of the columnar valve core is sleeved with at least one lap of sealing ring made of elastic material; preferably, a lap of convex rib protruding upwards is arranged on the bottom wall of the pressure adjusting chamber, and the convex rib, in the same size of the sealing gasket, is arranged coaxially with the sealing gasket arranged on the valve plate.

The disclosure further provides a washing machine, with the auto-feeding device according to any one of the above installed thereto, the water outlet of the auto-feeding device is connected to a washing tub to feed the additive in the liquid storage box sucked by inlet water to the water box into the washing tub along with the inlet water of the washing machine.

The disclosure has the advantageous effects as follows:

1. A pressure adjusting device is arranged in an inlet water path of a washing additive auto-feeding device provided in the disclosure to adjust inlet water flow pressure automatically, thus realizing automatic water diversion when the water supply flow pressure is excessively great, and further achieving the purposes of automatically adjusting the inlet water flow pressure and adaptively adjusting the water pressure at the water inlet end of the suction structure.

2. An anti-back suction device for automatically adjusting opening and closing of an air hole along with the pressure in a tube is arranged in a washing additive auto-feeding device provided in the disclosure, so as to correspondingly adjust the pressure in the tube and avoid existence of negative pressure in the tube, thus achieving the purpose of backflow prevention function.

3. The washing additive auto-feeding device provided in the disclosure is provided with an anti-back suction device therein which lifts and falls automatically with the pressure in the tube, to achieve the effect of automatically controlling opening and closing of the air hole, thus further realizing that the anti-back suction device closes the pressure adjusting opening with water pressure when water supply of the auto-feeding device is executed normally, and correspondingly opens the pressure adjusting opening under the effect of self-weight when negative pressure is generated and water supply is stopped.

Meanwhile, the disclosure is simple in structure and significant in effect, such that it is suitable to be promoted for use.

Main components of the drawings are described as follows: 100—a water supply flow channel, 200—a liquid storage box, 300—a washing tub, 400—a suction structure, 500—a pressure adjusting chamber, 600—a water box, 1—an inlet, 2—an outlet, 3—a pressure adjusting opening, 4—a valve core, 5—an elastic structure, 6—a valve plate, 7—an opening, 8—a bracket, 9—an end cover, 10—a diversion flow channel, 11—a sleeve, 12—a sealing gasket, 13—sealing ring, 13—a groove, 15—a convex rib, 50—a spring.

DETAILED DESCRIPTION

In order to make the technical problem solved in the disclosure, the technical solutions adopted, and the technical effects achieved clearer, the accompanying drawings will be incorporated below to further describe the embodiments of the disclosure in details.

Embodiment 1

Figure 1:
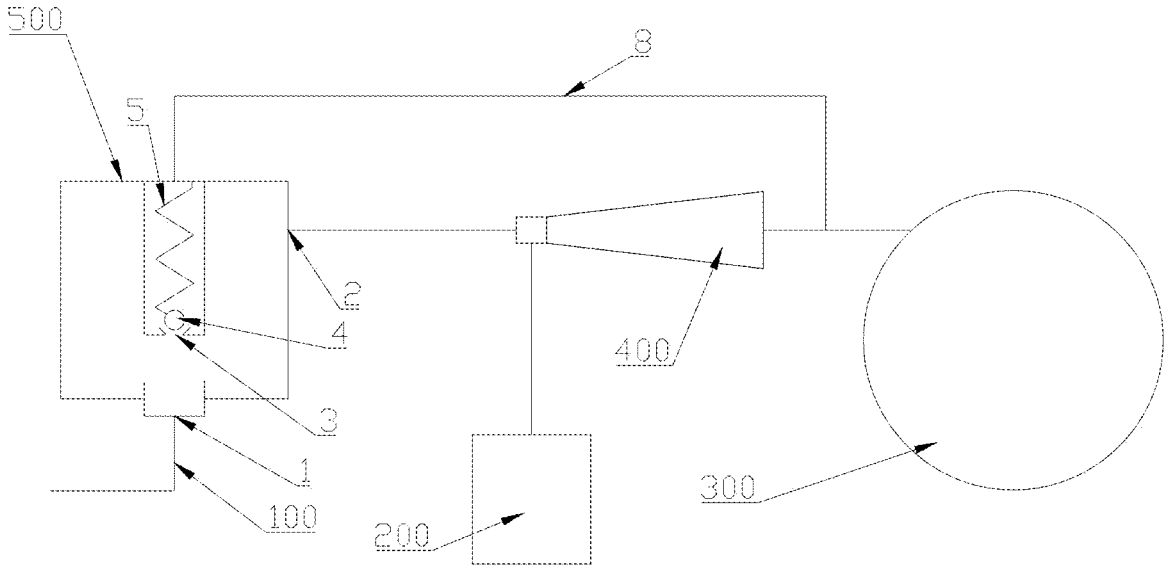
FIG. 1 is a connecting relationship diagram of an auto-feeding device in embodiment 1 of the disclosure.

The embodiment, as shown in FIG. 1, provides an additive auto-feeding device, including a water supply flow channel 100 which can transfer water to a suction structure 400; a liquid storage box 200 containing an additive inside, wherein the additive can be any one of current liquid detergent, softener, flavoring agent, disinfectant and the like; the suction structure 400 capable of sucking the additive in the liquid storage box 200 and then transferring the additive along with water flow to a water outlet by generating negative pressure for water flow in the water supply flow channel 100, wherein the suction structure 400 can be any one of current devices which can generate negative pressure to suck the additive to water flow, such as, a suction pump, a Venturi tube and the like; and a pressure adjusting device arranged on the water supply flow channel 100 for adjusting the pressure of flowing water so as to perform diversion of water flowing to the suction structure 400 when the pressure of water supply flow is excessively great.

A pressure adjusting device is arranged on an inlet water path of the washing additive auto-feeding device provided in the disclosure to adjust the inlet water flow pressure automatically, thus realizing automatic water diversion when the water supply flow pressure is excessively great, and further achieving the purposes of automatically adjusting the inlet water flow pressure and adaptively adjusting the water pressure at the water inlet end of the suction structure.

In the embodiment, a pressure adjusting chamber 500 is arranged on the water supply flow channel 100, a pressure adjusting opening 3 is arranged on the top of the pressure adjusting chamber 500, the pressure adjusting device is arranged at the pressure adjusting opening 3 and correspondingly covers and closes the pressure adjusting opening 3 under the effect of water flow pressure, such that the pressure adjusting device opens the pressure adjusting opening 3 under the pressure of water flow when the pressure of water supply flow is greater than a set value.

In the embodiment, the pressure adjusting device comprises a valve core 4 installed at the pressure adjusting opening 3 via an elastic structure 5, and the valve core 4 correspondingly seals the pressure adjusting opening 3 under an elastic force of the elastic structure 5, and when the pressure of water flowing through the pressure adjusting chamber 500 is greater than a set value, the water flow pressure overcomes the elastic force and drives the valve core to open the pressure adjusting opening 3.

In the embodiment, the valve core is arranged at the pressure adjusting opening 3 at the outer side of the pressure adjusting chamber 500, the elastic structure 5 provides an elastic force for the valve core 4 from the exterior of the pressure adjusting chamber 500 to the interior of the pressure adjusting chamber 500, thereby making the valve core 4 correspondingly seal the pressure adjusting opening 3; water flowing through the pressure adjusting chamber 500 applies pressure to the valve core 4 for moving outwards, and when water flow pressure is greater than a set value, the water flow pressure overcomes the elastic force to drive the valve core 4 to move outwards and open the pressure adjusting opening 3.

In the embodiment, the pressure adjusting opening 3 communicates with a diversion flow channel 10, and the end of the diversion flow channel 10 communicates with the water outlet of the auto-feeding device of the additive, so that after diversion, the inlet water is directly led to the water outlet after bypassing the suction structure 400, thereby avoiding breakage of a flow channel caused by too large impact on the suction structure 400.

Embodiment 2

Figure 2:
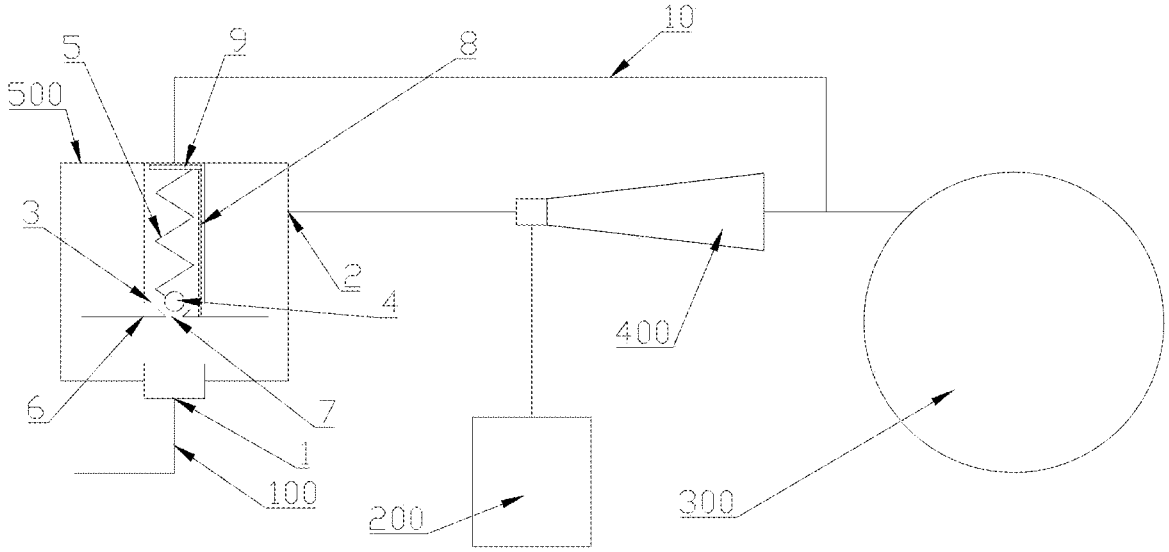
FIG. 2 is a connecting relationship diagram of an auto-feeding device in embodiments 2 and 3 of the disclosure.
Figure 3:
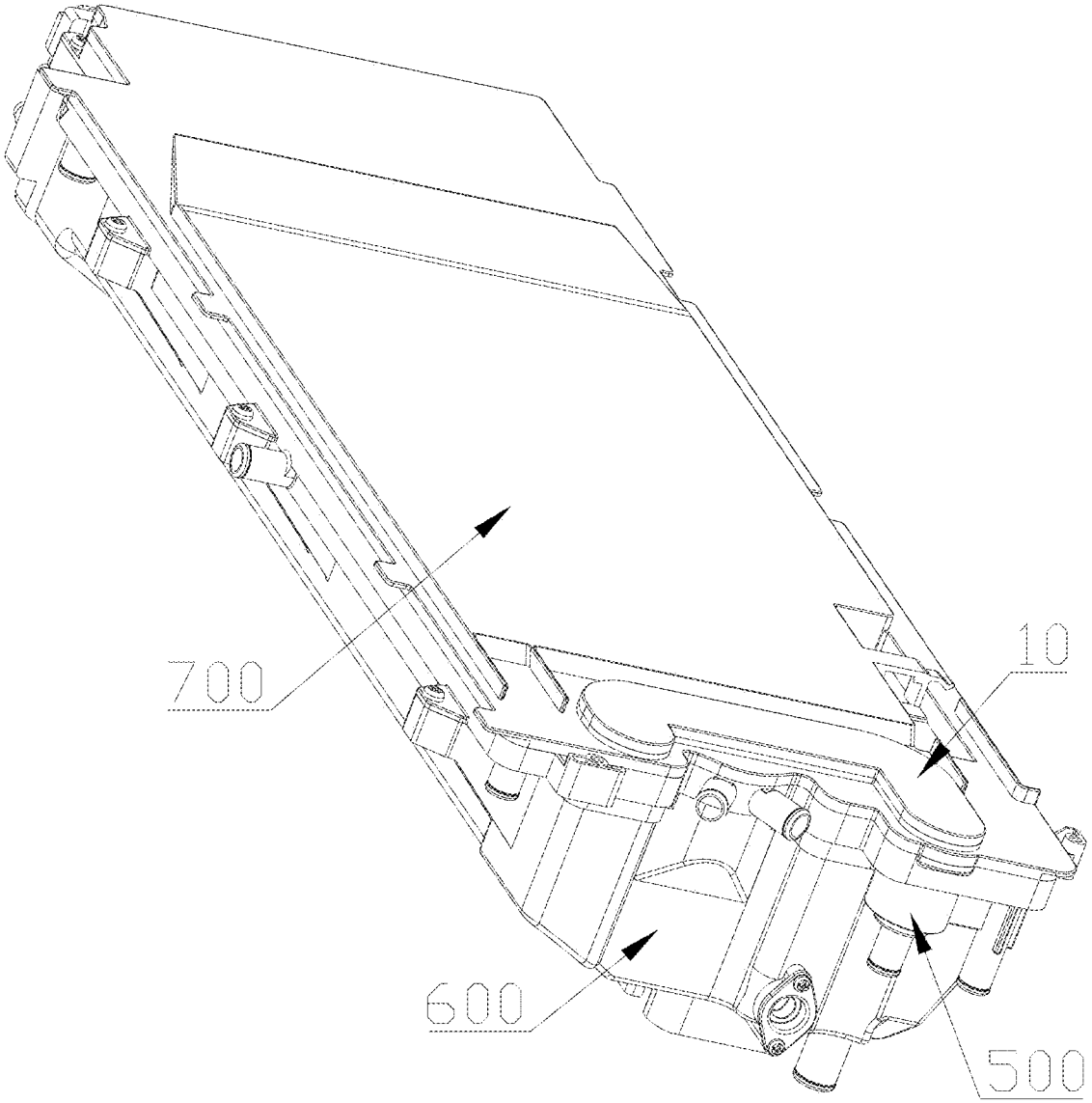
FIG. 3 is a structure diagram of an auto-feeding device in an embodiment of the disclosure.
Figure 4:
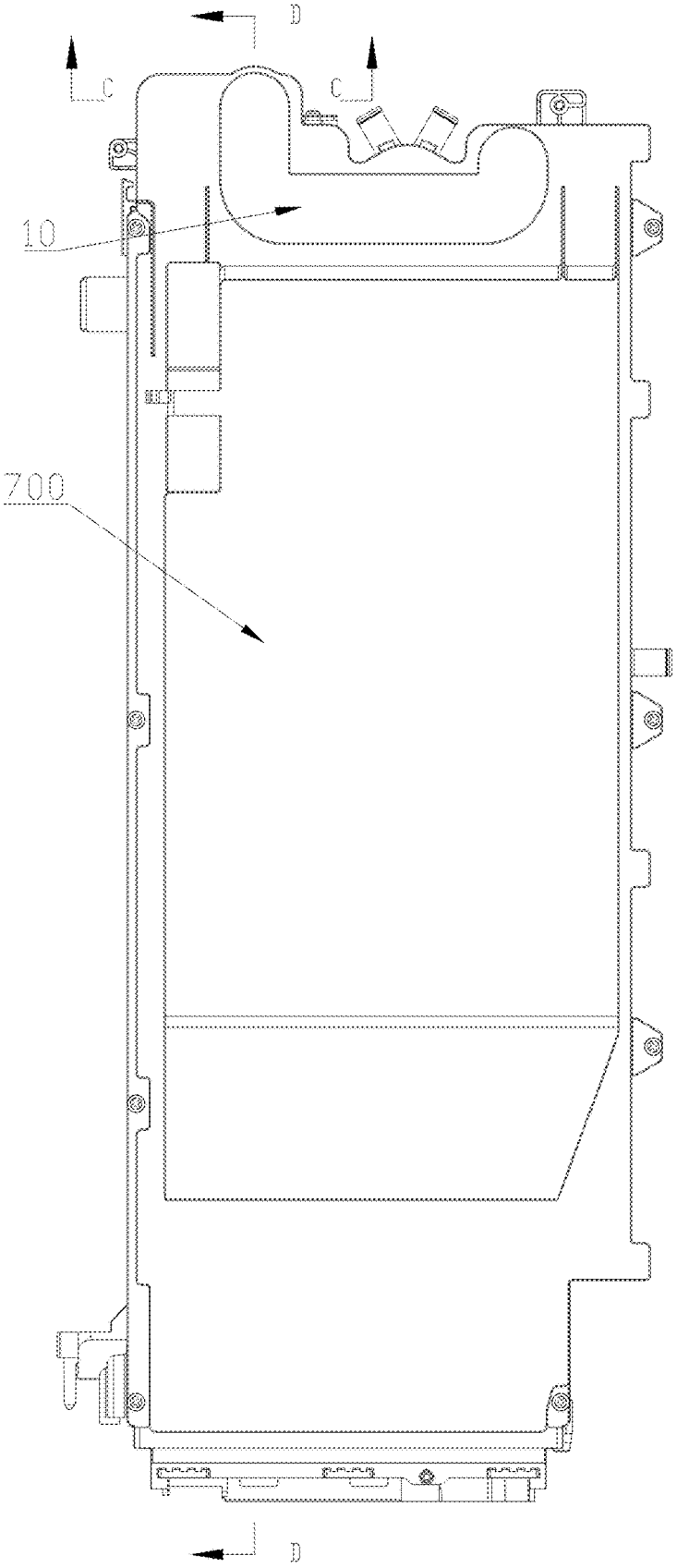
FIG. 4 is a top-view of an auto-feeding device in an embodiment of the disclosure.
Figure 5:
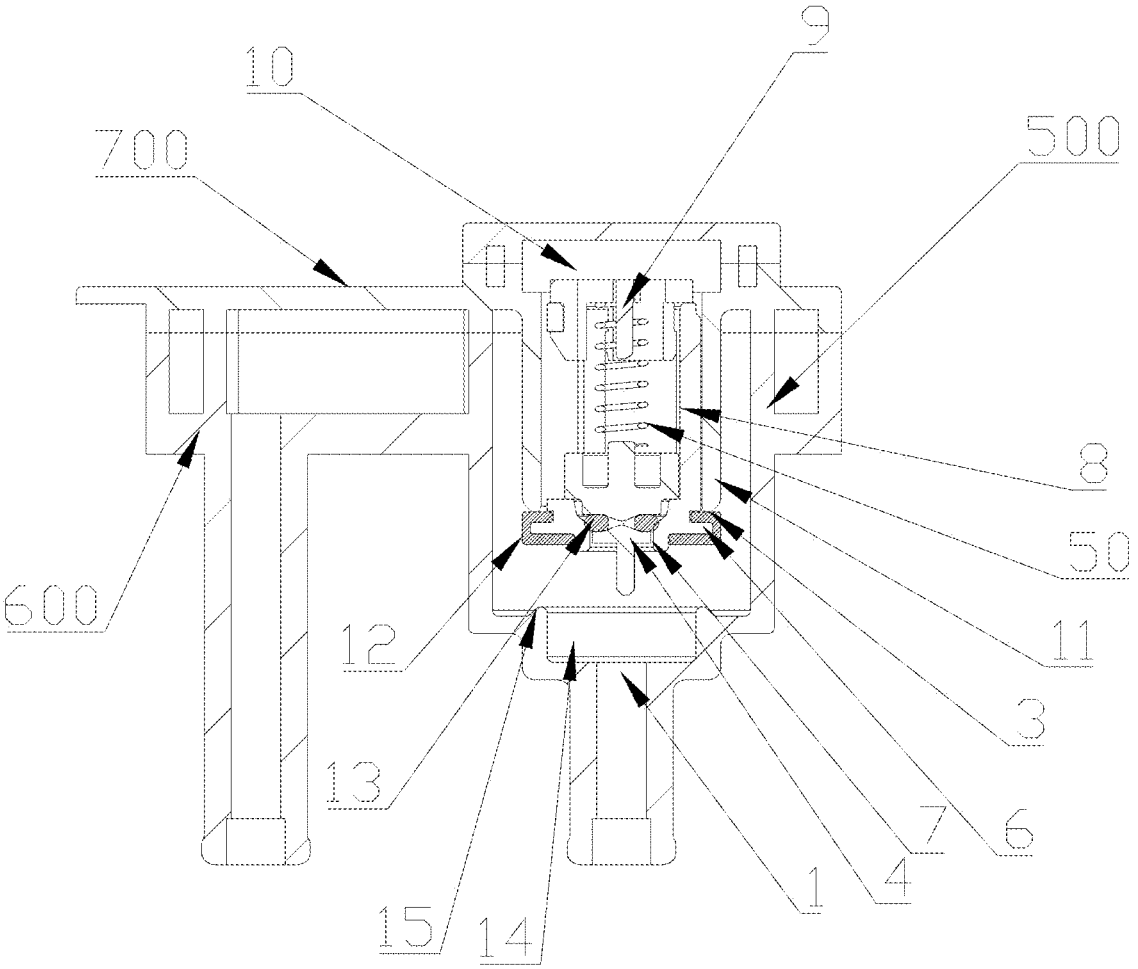
FIG. 5 is a C-C cross section structure diagram of FIG. 4 in an embodiment of the disclosure.
Figure 6:
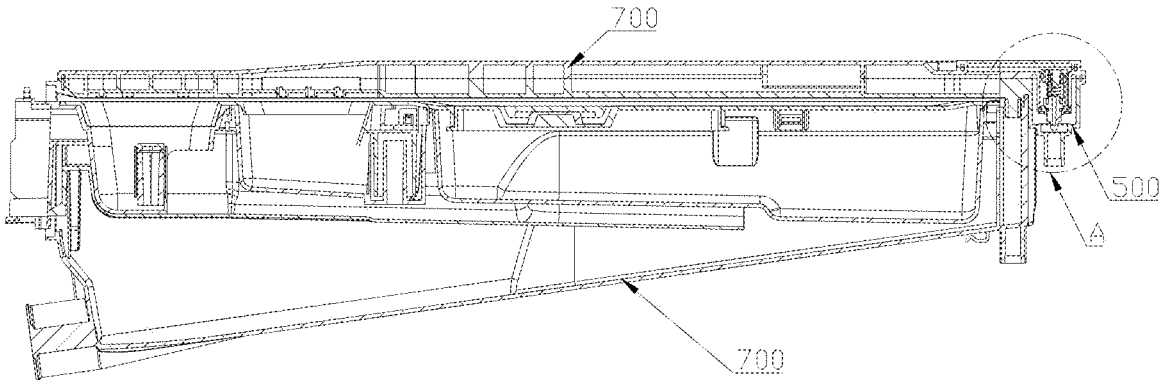
FIG. 6 is a D-D cross section structure diagram of FIG. 4 in an embodiment of the disclosure.
Figure 7:
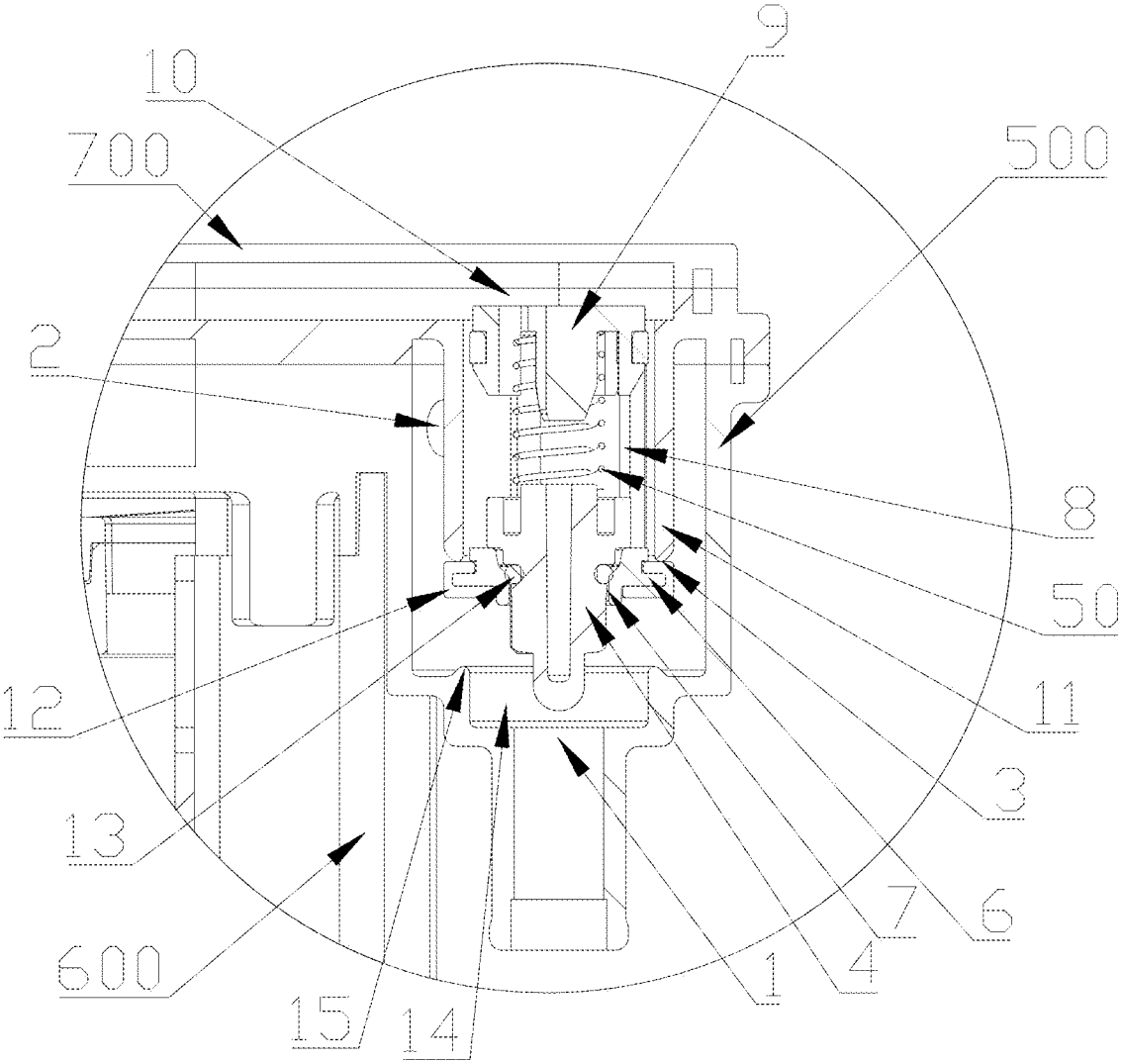
FIG. 7 is an enlarged structure diagram of part A of FIG. 6 in an embodiment of the disclosure.
Figure 8:
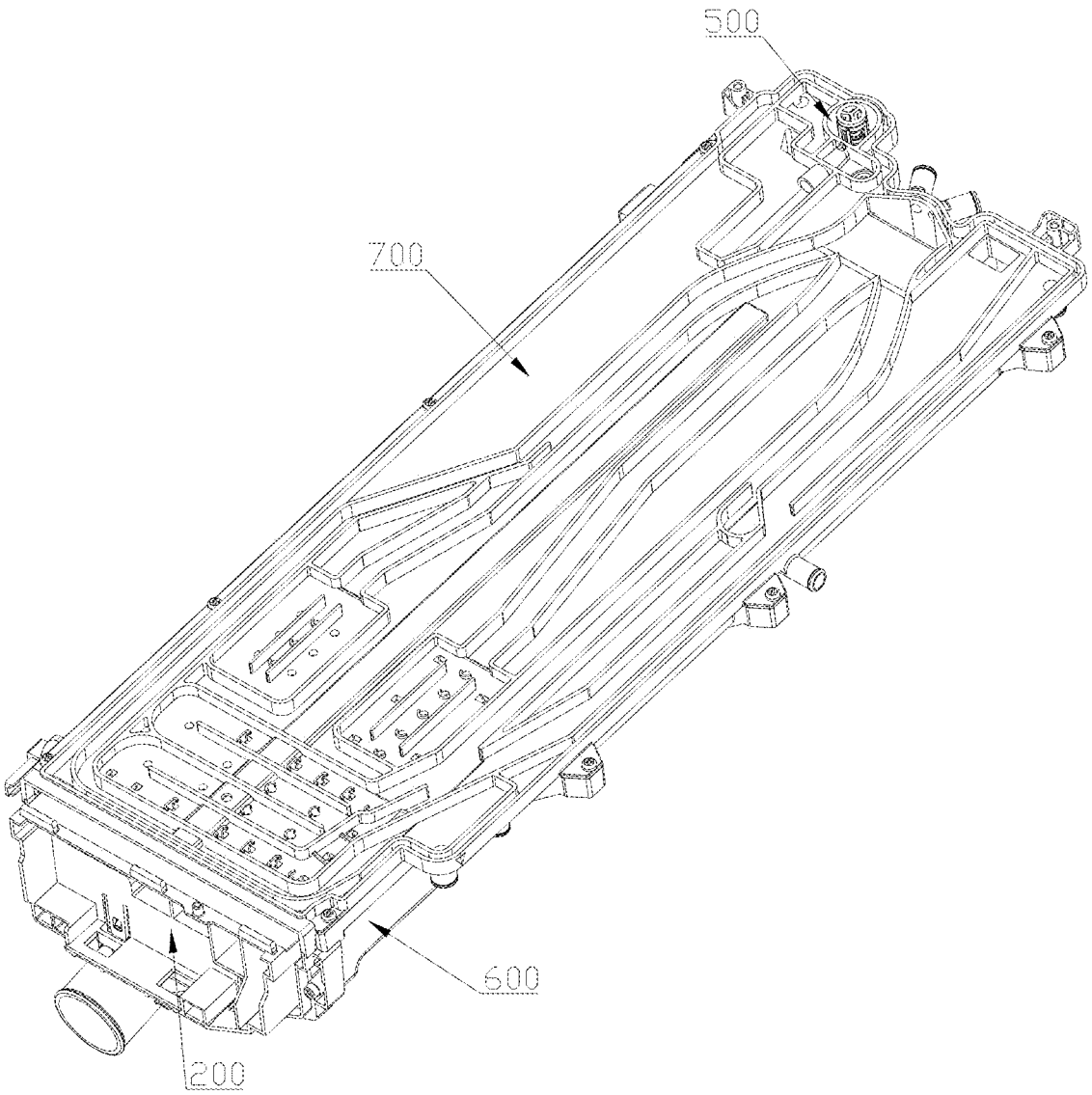
FIG. 8 is a mounting structure diagram of a pressure adjusting device of an auto-feeding device in an embodiment of the disclosure.
Figure 9:
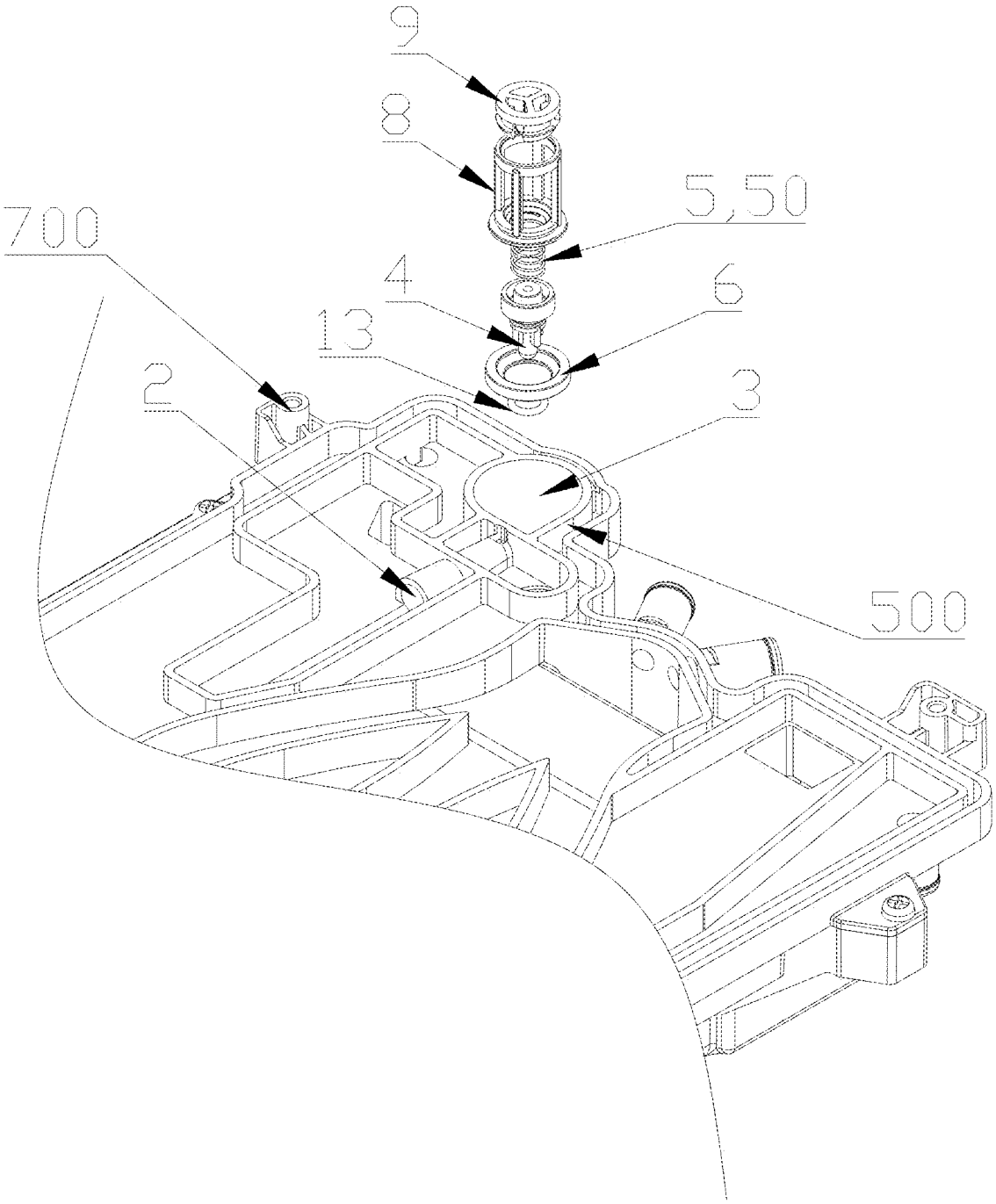
FIG. 9 is an exploded view of a pressure adjusting device of FIG. 6 in an embodiment of the disclosure.

The embodiment, based on the above Embodiment One, also has the following distinguishing features: in the embodiment, as shown in FIG. 2, the pressure adjusting device is installed in the pressure adjusting chamber 500 and can move vertically as a whole, so as to overcome self-gravity under pressure of water flowing into the pressure adjusting chamber 500 from the water supply flow channel 100 and drive the pressure adjusting device to rise as a whole to correspondingly seal the pressure adjusting opening 3; an opening 7 connecting the interior and the exterior of the chamber is arranged on the pressure adjusting device, the valve core 4 is correspondingly installed at the opening 7, and the valve core 4 correspondingly seals the opening 7 under an elastic force of the elastic structure 5, and when the pressure of water flowing through the pressure adjusting chamber 500 is greater than a set value, the pressure overcomes the elastic force and drives the valve core 4 to open the opening 7.

In the embodiment, the pressure adjusting device includes a horizontally arranged valve plate 6 which can generate movement up and down with a change in pressure of water flowing into the pressure adjusting chamber 500 through the water supply flow channel 100, such that the valve plate 6 is driven to correspondingly seal the pressure adjusting opening under the pressure of water flowing through the water supply flow channel 100 and the valve plate 6 opens the pressure adjusting opening 3 under gravity when negative pressure is generated in the water supply flow channel 100.

In the embodiment, an opening 7 penetrating upper and lower sides and connecting the interior and the exterior of the pressure adjusting chamber 500 is arranged on the valve plate 6, the valve core 4 is arranged at the opening 7 and is made to correspondingly seal the opening 7 under the driving of the elastic structure 5. In the embodiment, the valve core 4 is arranged at the opening 7 at the upper side of the valve plate 6, the elastic structure 5 provides an elastic force for the valve core 4 downwards and towards the interior of the pressure adjusting chamber 500, thereby making the valve core 4 correspondingly seal the opening 7 of the valve plate 6; water flowing through the pressure adjusting chamber 500 applies pressure to the valve core 4 for moving outwards, and when water flow pressure is greater than a set value, the water flow pressure overcomes the elastic force to drive the valve core 4 to move outwards and open the opening 7, and further the pressure adjusting opening 3 is opened, which makes inlet water with great flow and large pressure in the water supply flow channel 100 flow out through the opening 7 and the pressure adjusting opening 3 to realize the purpose of inlet water diversion.

In the embodiment, the valve plate 6 is provided with a limiting structure which correspondingly plugged with the pressure adjusting opening 3 to ensure that the valve plate 6 can only generate a vertical displacement under self-gravity and pressure of water flow. In the embodiment, the limiting structure is specifically as follows: the valve plate 6 is connected with a bracket 8 extending towards the outer side of the pressure adjusting chamber 500, a spring 50 in a compressed state is arranged between the bracket 8 and the valve plate 6, and the two ends of the spring 50 are respectively connected to the bracket 8 and the valve core 4. Preferably, in the embodiment, the valve plate 6 is provided with a bracket 8 penetrating the pressure adjusting opening 3 towards the outer side of the water supply flow channel 100, the outgoing end of the bracket 8 is provided with an end cover 9 having hollow holes, the spring 50 is clamped between the end cover 9 and the valve core 4 in a compressed state, the two ends of the spring 50 are respectively connected to the valve core 4 and the end cover 9, such that the valve plate 6 is limited to the pressure adjusting opening 3 by the bracket 8 and only generates movement back and forth along the axis of the pressure adjusting opening 3, thus making water flow diverged in the pressure adjusting chamber 500 flows out of the water supply flow channel 100 from the opening 7 and the pressure adjusting opening 3 to achieve the purpose of automatic pressure adjustment and diversion of the inlet water.

In the embodiment, the periphery of the valve plate 6 protrudes from the pressure adjusting opening 3 for sealed contact of the valve plate 6 with the inner wall of the water supply flow channel 100 when the valve plate 6 seals the pressure adjusting opening 3 under the water pressure, and at least one lap of sealing ring is arranged at an abutted surface of the valve plate 6 and the water supply flow channel 100. Preferably, the periphery of the valve plate 6 is packed with a lap of sealing ring made of elastic material. In the embodiment, the periphery of the valve core 4 is sleeved with a lap of sealing ring, such that the sealing ring arranged on the valve core 4 is located at an abutted surface of the valve core 4 and the valve plate 6 when the valve core 4 is in corresponding sealing contact with the opening 7 of the valve plate 6, so as to ensure the sealing performance of the opening 7 of the valve plate.

Embodiment 3

The embodiment, as shown in FIG. 2, provides an additive auto-feeding device, including a water supply flow channel 100 which can transfer water to a suction structure 400; a liquid storage box 200 containing an additive inside, wherein the additive can be any one of current liquid detergent, softener, flavoring agent, disinfectant and the like; the suction structure 400 capable of sucking the additive in the liquid storage box 200 and then transferring the additive along with water flow to a water outlet by generating negative pressure for water flow in the water supply flow channel 100; wherein the suction structure 400 can be any one of current devices which can generate negative pressure to suck the additive to the water flow, such as, a suction pump, a Venturi tube and the like; and an anti-back suction device arranged at a pressure adjusting opening 3 of the water supply flow channel 100, wherein when water enters the water supply flow channel 100, under the pressure effect of flowing water, the anti-back suction device is controlled to close the pressure adjusting opening 3; and when negative pressure is generated in the water supply flow channel 100, the anti-back suction device is controlled to open the pressure adjusting opening 3 for adjusting the negative pressure in the water supply flow channel 100.

An anti-back suction device for automatically adjusting opening and closing of an air hole along with the pressure in a tube is arranged in a washing additive auto-feeding device provided in the disclosure, so as to correspondingly adjust the pressure in the tube and avoid existence of negative pressure in the tube, thus achieving the purpose of backflow prevention function. Meanwhile, the washing additive auto-feeding device provided in the disclosure is provided with an anti-back suction device therein which lifts and falls automatically with the pressure in the tube, to achieve the effect of automatically controlling opening and closing of the air hole, thus further realizing that the anti-back suction device closes the pressure adjusting opening with water pressure when water supply of the auto-feeding device is executed normally, and correspondingly opens the pressure adjusting opening under the effect of self-weight when negative pressure is generated and water supply is stopped.

In the embodiment, the anti-back suction device includes a valve plate 6 correspondingly covering the pressure adjusting opening 3 at the inner side of the water supply flow channel 100. The periphery of the valve plate 6 protrudes from the pressure adjusting opening 3 for sealed contact of the valve plate 6 with the inner wall of the water supply flow channel 100 when the valve plate 6 seals the pressure adjusting opening 3 under the water pressure, and at least one lap of sealing ring is arranged at an abutted surface of the valve plate 6 and the water supply flow channel 100.

In the embodiment, the upper and lower sides of the pressure adjusting chamber 500 in the vertical direction are respectively provided with an inlet 1 and a pressure adjusting opening 3, one side wall of the pressure adjusting chamber 500 is provided with an outlet 2 connected with the suction structure 400, and the valve plate 6 overcomes gravity and moves upwards to close the pressure adjusting opening 3 under the pressure of water flowing into the chamber. Preferably, the inlet 1 is arranged coaxially with the pressure adjusting opening 3.

In the embodiment, the lower side of the valve plate 6 is arranged opposite to the inlet 1 for moving downwards to seal and cover the inlet 1 under gravity, when water supply in the water supply flow channel 100 is stopped and negative pressure is generated in the pressure adjusting chamber 500.

In the embodiment, the outer side of the valve plate 6 towards the water supply flow 100 is provided with a bracket 8 penetrating the pressure adjusting opening 3, and the upper end of the bracket 8 passes though the pressure adjusting opening 3 and is provided with an end cover 9 to make the valve plate 6 only generate movement back and forth along the axis of the pressure adjusting opening 3 under the limiting effect of the bracket 8.

In the embodiment, an opening 7 is arranged on the valve plate 6, a valve core 4 is installed at the opening 7, the valve core 4 is installed to the opening 7 via an elastic structure 5, the valve core 6 correspondingly seals the pressure adjusting opening 3 under an elastic force of the elastic structure 5, when the pressure of water flowing through the pressure adjusting chamber 500 is greater than a set value, the water flow pressure overcomes the elastic force and drives the valve core 4 to open the pressure adjusting opening 3.

In the embodiment, the valve core 4 is arranged at the pressure adjusting opening 3 at the outer side of the pressure adjusting chamber 500, the elastic structure 5 provides an elastic force for the valve core 4 from the exterior of the pressure adjusting chamber 500 to the interior of the pressure adjusting chamber, thereby making the valve core 4 correspondingly seal the pressure adjusting opening 3; water flowing through the pressure adjusting chamber 500 applies pressure to the valve core 4 for moving outwards, and when water flow pressure is greater than a set value, the water flow pressure overcomes the elastic force to drive the valve core 4 to move outwards and open the pressure adjusting opening 3.

In the embodiment, the pressure adjusting opening 3 communicates with the diversion flow channel 10, the end of the diversion flow channel 10 communicates with the water outlet of the auto-feeding device, the water outlet is located inside the water box of the auto-feeding device, and the pressure at the water outlet is air pressure or arranged equally with the pressure in the washing tub 300 of the washing machine.

In the embodiment, a pressure adjusting chamber 500 is arranged on the water supply flow channel 100, a pressure adjusting opening 3 is arranged on the pressure adjusting chamber 500, the valve plate 6 correspondingly covers the pressure adjusting opening 3 at the inner side of the pressure adjusting chamber 500, the valve plate 6 correspondingly seals the pressure adjusting opening 3 under the pressure of water in the chamber; the valve core 4 correspondingly covers the opening 7 of the valve plate 6 at the outer side of the pressure adjusting chamber 500 and the valve core 4 opens or has the trend of opening the opening 7 under the pressure of water in the chamber.

Embodiment 4

As shown in FIGS. 1 to 9, the embodiment introduces an auto-feeding device, including a water box 600, wherein a pressure adjusting chamber 500 is arranged on the water box 600, an inlet 1 connected with a water inlet tube and an outlet 2 connected with a suction structure 400 are arranged on the pressure adjusting chamber 500, the top of the pressure adjusting chamber 500 is further provided with a pressure adjusting opening 3 communicating with the exterior, a valve plate 6 which can move vertically is arranged in the pressure adjusting chamber 500 to correspondingly seal or open the pressure adjusting opening 3 under the pressure in the chamber; an opening 7 is arranged on the valve plate 6, and a valve core 4 for sealing the opening 7 is arranged at the opening 7, and the valve core 4 is installed on the valve plate 6 via an elastic structure 5 and driven to open the opening 7 when the pressure of water flowing in the water supply flow channel 100 is excessively great.

In the embodiment, the outlet 2 is arranged at one side of the pressure adjusting chamber 500 and connected to a small-caliber inlet end of a Venturi tube forming the suction structure 400; the inlet 1 is arranged at the bottom of the pressure adjusting chamber 500 and the inlet of the pressure adjusting chamber 500 is arranged coaxially with the pressure adjusting opening 3.

In the embodiment, the top wall of the pressure adjusting chamber 500 is provided with a through sleeve 11, a hollow channel in the sleeve 11 forming the pressure adjusting opening 3; the valve plate 6 is arranged at the lower end of the sleeve and correspondingly covers the lower end of the sleeve 11, and the valve plate 6 is connected with a limiting structure plugged with the sleeve 11 such that the valve plate 6 moves back and forth along the vertical direction under the joint effect of gravity and water flow pressure.

In the embodiment, the limiting structure includes a vertically extending bracket 8, the outer wall of the bracket 8 correspondingly contacts with the inner wall of the sleeve 11, such that the bracket 8 is limited by the sleeve 11, the lower end of the bracket 8 is fixedly connected to the valve plate 6, the upper end of the bracket 8 is provided with an end cover 9; the height of the bracket 8 is not greater than the height of the sleeve 11 and not less than a height difference between the lower end of the sleeve 11 and the inlet of the pressure adjusting chamber 500. In the embodiment, the end cover 9 is provided with a plurality of hollow holes penetrating the upper and lower sides of the end cover 9. Preferably, the end cover 9 is provided with an annular rib covering the periphery and a plurality of straight ribs arranged at intervals along the radial direction, the inner ends of the straight ribs being converged and fixed to the center of the annular rib, and the outer ends of the straight ribs being fixed to the inner circumference of the annular rib. The intervals between each straight ribs form the hollow holes penetrating the upper and lower sides.

In the embodiment, an opening 7 is arranged at the center of the valve plate 6, the valve core 4 has a columnar shape and penetrates the opening 7, the upper end of the columnar valve core 4 is provided with a lap of protruding portion protruding outwards, and the periphery of the protruding portion is beyond the opening 7, such that the columnar valve core 4 correspondingly seals the opening 7 downwards under gravity.

In the embodiment, the bottom of the pressure adjusting chamber 500 is provided with a groove 14 sunken downwards, the shape of the groove 14 opening is arranged corresponding to the valve plate 6 such that the lower side of the valve plate 6 is in sealing contact with the periphery of the groove 14 opening of the pressure adjusting chamber 500 when the valve plate 6 falls to the bottom of the pressure adjusting chamber 500 under gravity and/or negative pressure for closing the inlet. Preferably, a lap of convex rib 15 protruding upwards is arranged on the bottom wall of the pressure adjusting chamber 500, and the convex rib 15, in the same size of a sealing gasket 12, is arranged coaxially with the sealing gasket 12 arranged on the valve plate 4, to make the sealing gasket 12 correspondingly seal the inlet 1 when the valve plate 6 falls to the bottom of the pressure adjusting chamber under negative pressure and/or self-weight.

In the embodiment, the lower end of the columnar valve core 4 protrudes from the valve plate 6 and is corresponding to the inlet 1 of the pressure adjusting chamber 500 such that the lower end of the columnar valve core 4 is correspondingly plugged with the inlet 1 in a sealing manner when the valve plate 6 falls to the bottom of the pressure adjusting chamber 500 under gravity and/or negative pressure. Preferably, the lower end of the columnar valve core 4 presents a smooth hemispherical shape and the peripheral side of the columnar valve core 4 is correspondingly fitted contact to the inner wall of the tube of the inlet 1 at the lower end of the pressure adjusting chamber 500, so that the columnar valve core 4 and the inlet 1 are in sealing contact after the lower end of the columnar valve core 4 is correspondingly inserted into the inlet 1, thus further realizing the purpose of sealing the inlet 1 of the pressure adjusting chamber 500 by the columnar valve core 4 after the valve 6 falls down as a whole.

In the embodiment, the inlet 1 of the pressure adjusting chamber 500 is arranged between the sleeve 11 and a side wall of the pressure adjusting chamber 500, the outer circumference of the valve plate 6 is greater than the circumference of the lower end of the sleeve 11 and smaller than the circumference of the inner side wall of the pressure adjusting chamber 500, such that water flowing into the chamber from the inlet flows to the outlet 2 from a gap between the sleeve 11 and the wall of the pressure adjusting chamber 500.

In the embodiment, the elastic structure 5 is a vertically extending spring 50, which is installed between the end cover 9 of the bracket and the valve core 4 in a compressed state, and the two ends of the spring 50 being respectively connected to the end cover 9 and the valve core 4. In the embodiment, the bracket 8 includes a plurality of vertically extending connecting ribs, the upper end of the connecting rib is fixedly connected to the end cover 9, and the lower end of the connecting rib is fixedly connected to the valve plate 6, and a hollow area for water to flow through is arranged between adjacent connecting ribs and/or on the connecting ribs. Preferably, the connecting ribs each are arranged along a barrel face fitted contacted to the inner wall of the sleeve 11 and the spring 50 is arranged in an area enclosed by the connecting ribs.

In the embodiment, the water box 600 of the auto-feeding device includes a top cover 700 buckled to the top, the top cover 700 being provided with a pressure adjusting chamber 500 protruding downwards; the pressure adjusting chamber 500 and the top cover 700 or the water box 600 are integrally formed; the upper side of the top cover 700 is provided with a diversion flow channel 10, the pressure adjusting opening arranged on the top of the pressure adjusting chamber 500 communicates with the diversion flow channel 10, which extends to the outlet 2 of the water box 600 or into the washing tub 300, thus making the inlet water subjected to pressure adjustment directly flows into the water box 600 to realize the purpose of automatic pressure adjustment of inlet water flow. Meanwhile, the pressure adjusting opening 3 is made to directly communicate with the external atmosphere to adjust the negative pressure in the water supply flow channel 100.

In the embodiment, the abutted surface of the valve plate 6 and the pressure adjusting opening 3 is provided with at least one lap of sealing ring, the abutted surface of the valve plate 6 and the inlet 1 of the pressure adjusting chamber 500 is provided with at least one lap of sealing ring, and the abutted surface of the valve plate 6 and the valve core 4 is provided with at least one lap of the sealing ring 13. In the embodiment, the periphery of the valve plate 6 is packed with a layer of sealing gasket 12 made of elastic material and covering the upper and lower sides of the valve plate 6; the periphery of the middle part of the columnar valve core 4 is sleeved with at least one lap of sealing ring 13 made of elastic material. Preferably, a lap of convex rib 15 protruding upwards is arranged on the bottom wall of the pressure adjusting chamber 500, the convex rib 15, in the same size of the sealing gasket 12, being arranged coaxially with the sealing gasket 12 arranged on the valve plate 6.

Embodiment 5

The embodiment further provides a washing machine, with the auto-feeding device according to any one of embodiments 1 to 4 installed thereto, the water outlet of the auto-feeding device is connected to a washing tub 300 to feed the additive in the liquid storage box 200 sucked by inlet water to the water box 600 into the washing tub 300 along with the inlet water of the washing machine.

The above are merely preferred embodiments of the disclosure and the technical principles applied thereto. Those skilled in the art should understand that the disclosure is not restricted to the particular embodiments described herein. For those skilled in the art, various obvious changes, re-adjustment and substitutions can be made, without departing from the protection scope of the disclosure.

The invention claimed is:

1. An additive auto-feeding device, comprising:

a water supply flow channel;

a liquid storage box containing an additive inside;

a suction structure being configured to suck the additive in the liquid storage box to the water supply flow channel and transfer the additive along with water flow to a water outlet; and an anti-back suction device being arranged at a pressure adjusting opening of the water supply flow channel, the anti-back suction device comprising a valve plate, a valve core and an elastic structure, wherein the valve plate is provided with an opening; the valve core is installed at the opening via the elastic structure;

a pressure adjusting chamber is arranged on the water supply flow channel, the pressure adjusting opening is arranged on the pressure adjusting chamber, the valve plate correspondingly seals the pressure adjusting opening under a pressure of water in the chamber; the valve core correspondingly covers the opening of the valve plate at an outer side of the pressure adjusting chamber and the valve core opens or has a trend of opening the opening under the pressure of water in the chamber.

2. The additive auto-feeding device according to claim 1, wherein a periphery of the valve plate protrudes from the pressure adjusting opening for sealed contact of the valve plate with the inner wall of the water supply flow channel when the valve plate seals the pressure adjusting opening under water pressure, and at least one lap of sealing ring is arranged at an abutted surface of the valve plate and the water supply flow channel.

3. The additive auto-feeding device according to claim 2, wherein an outer side of the valve plate towards the water supply flow channel is provided with a bracket penetrating the pressure adjusting opening, an outgoing end of the bracket is provided with an end cover and a spring structure is clamped between the end cover and the valve core to make the valve plate only capable of moving back and forth along an axis of the pressure adjusting opening under a limiting of the bracket.

4. The additive auto-feeding device according to claim 2, wherein the valve core correspondingly seals the pressure adjusting opening under an elastic force of the elastic structure, when a pressure of water flowing through the pressure adjusting chamber is greater than a set value, the water flow pressure overcomes an elastic force and drives the valve core to open the pressure adjusting opening for pressure adjustment and diversion of water in the water supply flow channel.

5. The additive auto-feeding device according to claim 4, wherein the valve core is arranged at the pressure adjusting opening at an outer side of the pressure adjusting chamber, the elastic structure provides an elastic force for the valve core from an exterior of the pressure adjusting chamber to an interior of the pressure adjusting chamber, thereby making the valve core correspondingly seal the pressure adjusting opening; water flowing through the pressure adjusting chamber applies pressure to the valve core for moving outwards, and when the water flow pressure is greater than the set value, the water flow pressure overcomes the elastic force to drive the valve core to move outwards and open the pressure adjusting opening.

6. The additive auto-feeding device according to claim 1, wherein the pressure adjusting opening communicates with a diversion flow channel, and the end of the diversion flow channel communicates with the water outlet of the auto-feeding device.

7. The additive auto-feeding device according to claim 1, wherein the pressure adjusting chamber is arranged on the water supply flow channel, the pressure adjusting opening is arranged on the pressure adjusting chamber, the valve plate correspondingly covers the pressure adjusting opening at the inner side of the pressure adjusting chamber, and the valve plate correspondingly seals the pressure adjusting opening under the pressure of water in the chamber; the valve core correspondingly covers an opening of the valve plate at the outer side of the pressure adjusting chamber so that the valve core opens or trends to open the opening under the pressure of water in the chamber.

8. The additive auto-feeding device according to claim 7, wherein an upper side and a lower side of the pressure adjusting chamber in a vertical direction are respectively provided with an inlet and the pressure adjusting opening, one side wall of the pressure adjusting chamber is provided with an outlet connected with the suction structure, and the valve plate overcomes gravity under the pressure of water flowing into the chamber to move upward to close the pressure adjusting opening;

the inlet and the pressure adjusting opening are arranged coaxially.

9. The additive auto-feeding device according to claim 8, wherein a lower side of the valve plate is arranged opposite to the inlet for moving downwards to seal and cover the inlet under gravity, when water supply in the water supply flow channel is stopped and negative pressure is generated in the pressure adjusting chamber.

10. The additive auto-feeding device according to claim 1, comprising a water box, wherein the pressure adjusting chamber is arranged on the water box, an inlet connected with a water inlet tube and an outlet connected with a suction structure are arranged on the pressure adjusting chamber, a top of the pressure adjusting chamber is further provided with the pressure adjusting opening communicating with exterior, the valve plate which moves vertically is arranged in the pressure adjusting chamber to correspondingly seal or open the pressure adjusting opening under a pressure in the chamber; an opening is arranged on the valve plate, and the valve core for sealing the opening is arranged at the opening, and the valve core is installed to the valve plate through an elastic structure and driven to open the opening when a pressure of water flowing in the water supply flow channel is excessively great.

11. The additive auto-feeding device according to claim 10, wherein the outlet is arranged at one side of the pressure adjusting chamber and connected to a small-caliber inlet end of a Venturi tube to form the suction structure; the inlet is arranged at a bottom of the pressure adjusting chamber and the inlet of the pressure adjusting chamber is arranged coaxially with the pressure adjusting opening.

12. The additive auto-feeding device according to claim 11, wherein a top wall of the pressure adjusting chamber is provided with a through sleeve, a hollow channel in the sleeve forming the pressure adjusting opening; the valve plate is arranged at a lower end of the sleeve and correspondingly covers the lower end of the sleeve, and the valve plate is connected with a limiting structure plugged with the sleeve such that the valve plate moves back and forth along a vertical direction under a joint effect of gravity and water flow pressure;

the limiting structure comprises a bracket vertically extending, an outer wall of the bracket correspondingly contacts with an inner wall of the sleeve, such that the bracket is limited by the sleeve, a lower end of the bracket is fixedly connected to the valve plate; a height of the bracket is not greater than a height of the sleeve and not less than a height difference between the lower end of the sleeve and the inlet of the pressure adjusting chamber;

the end cover is provided with a plurality of hollow holes penetrating the upper and lower sides of the end cover.

13. The additive auto-feeding device according to claim 10, wherein a top wall of the pressure adjusting chamber is provided with a through sleeve, a hollow channel in the sleeve forming the pressure adjusting opening; the valve plate is arranged at a lower end of the sleeve and correspondingly covers the lower end of the sleeve, and the valve plate is connected with a limiting structure plugged with the sleeve such that the valve plate moves back and forth along a vertical direction under a joint effect of gravity and water flow pressure;

the limiting structure comprises a bracket vertically extending, an outer wall of the bracket correspondingly contacts with an inner wall of the sleeve, such that the bracket is limited by the sleeve, a lower end of the bracket is fixedly connected to the valve plate; a height of the bracket is not greater than a height of the sleeve and not less than a height difference between the lower end of the sleeve and the inlet of the pressure adjusting chamber;

the end cover is provided with a plurality of hollow holes penetrating the upper and lower sides of the end cover.

14. The additive auto-feeding device according to claim 13, wherein the opening is arranged at a center of the valve plate, the valve core is in a columnar shape and penetrates the opening, an upper end of the columnar valve core is provided with a lap of protruding portion protruding outwards, and a periphery of the protruding portion is beyond the opening, such that the columnar valve core correspondingly seals the opening downwards under gravity.

15. The additive auto-feeding device according to claim 14, wherein a bottom of the pressure adjusting chamber is provided with a groove sunken downwards, a shape of the groove opening is arranged corresponding to the valve plate such that a lower side of the valve plate is in sealing contact with a periphery of the groove opening of the pressure adjusting chamber when the valve plate falls to a bottom of the pressure adjusting chamber under gravity and/or negative pressure for closing the inlet;

a lower end of the columnar valve core protrudes from the valve plate and is corresponding to the inlet of the pressure adjusting chamber such that the lower end of the columnar valve core is correspondingly plugged with the inlet in a sealing manner when the valve plate falls to the bottom of the pressure adjusting chamber under gravity and/or negative pressure.

16. The additive auto-feeding device according to claim 13, wherein the inlet of the pressure adjusting chamber is arranged between the sleeve and a side wall of the pressure adjusting chamber, an outer circumference of the valve plate is greater than a circumference of the lower end of the sleeve and smaller than a circumference of the inner side wall of the pressure adjusting chamber, such that water flowing into the chamber from the inlet flows to the outlet from a gap between the sleeve and the wall of the pressure adjusting chamber.

17. The additive auto-feeding device according to claim 13, wherein the elastic structure is a spring vertically extending, and the spring is installed between an end cover of the bracket and the valve core in a compressed state, the two ends of the spring is respectively connected to the end cover and the valve core;

the bracket comprises a plurality of connecting ribs vertically extending, an upper end of each of the connecting ribs is fixedly connected to the end cover, and a lower end of each of the connecting ribs is fixedly connected to the valve plate, and a hollow area for water to flow through is arranged between the connecting ribs adjacent each other and/or on the connecting ribs;

the connecting ribs are arranged along a barrel face fitted contacted to the inner wall of the sleeve and the spring is arranged in an area enclosed by the connecting ribs.

18. The additive auto-feeding device according to claim 10, wherein the water box comprises a top cover buckled to the top, the top cover further correspondingly covers and buckles to a top of the pressure adjusting chamber, the pressure adjusting chamber is integrally formed with the water box or the top cover; an upper side of the top cover is provided with a diversion flow channel, the pressure adjusting opening arranged on the top of the pressure adjusting chamber communicates with the diversion flow channel, the diversion adjusting chamber extends to the water outlet of the water box or into the washing tub, such that the pressure adjusting opening directly communicates with external atmosphere.

19. The additive auto-feeding device according to claim 10, wherein at least one lap of sealing ring is arranged at an abutted surface of the valve plate and the pressure adjusting opening, at least one lap of sealing ring is arranged at an abutted surface of the valve plate and the inlet of the pressure adjusting chamber, and at least one lap of sealing ring is arranged at an abutted surface of the valve plate and the valve core;

the periphery of the valve plate is packed with a sealing gasket consisting of a layer of elastic material and covering the upper and lower sides of the valve plate; and the periphery of the middle part of the columnar valve core is sleeved with at least one lap of sealing ring made of elastic material;

a lap of convex rib protruding upwards is arranged on the bottom wall of the pressure adjusting chamber, and the convex rib, in the same size of the sealing gasket, is arranged coaxially with the sealing gasket arranged on the valve plate.

20. A washing machine, wherein: the auto-feeding device according to claim 1 is installed thereto, the water outlet of the auto-feeding device is connected to a washing tub to feed the additive in the liquid storage box sucked by inlet water to the water box into the washing tub along with the inlet water of the washing machine.

* * * * *